United States Patent [19]

Vinai

[11] Patent Number: 4,625,335

[45] Date of Patent: Dec. 2, 1986

[54] RESCUE AND SECURING HARNESS INTEGRALLY AFFIXED TO A GARMENT

[76] Inventor: Mario Vinai, Via Montello 25, Brescia, Italy

[21] Appl. No.: 741,550

[22] Filed: Jun. 5, 1985

[30] Foreign Application Priority Data

Jun. 5, 1984 [IT] Italy ..... 21259 A/84
Apr. 15, 1985 [IT] Italy ..... 21449/85[U]

[51] Int. Cl.[4] ..... A41D 13/00; A62B 35/00

[52] U.S. Cl. ..... 2/69; 2/310; 182/3

[58] Field of Search ..... 182/3–6; 128/134; 2/309, 310, 311–318, 327, 69, 338, 94, 81, 49 R; 272/61, 24; 244/151 R, 151 A, 151 B

[56] References Cited

U.S. PATENT DOCUMENTS 2,979,153 4/1961 Hoagland et al. ..... 182/3
3,176,793 4/1965 Hlacia ..... 2/310 X
3,701,395 10/1972 Theobald ..... 182/3
4,553,633 11/1985 Armstrong et al. ..... 182/3

FOREIGN PATENT DOCUMENTS 655912 6/1935 Fed. Rep. of Germany ..... 182/6
878350 9/1961 United Kingdom ..... 244/151

*Primary Examiner*—Werner H. Schroeder
*Assistant Examiner*—Andrew M. Falik
*Attorney, Agent, or Firm*—Charles E. Brown; Charles A. Brown

[57] ABSTRACT

An overalls or a similar article of apparel carries, integrally therewith, a rescue and safety harness, sewn to the garment or otherwise permanently affixed thereto which comprises a strap section running down the user's backbone, two oblique strap-sections which attain and surround the user's iliac crests and extend frontally, and two sections running along the user's groin-lines and along the user's thigh-glutei lines. An alternative embodiment provides supplemental grip points to permit securing of persons working in dangerous locations.

8 Claims, 6 Drawing Figures

1
2
3s
3d
4s
4d
5s
5d 6
7d
7s
10d
10s
9d
9s
5d
5s

RESCUE AND SECURING HARNESS INTEGRALLY AFFIXED TO A GARMENT

BACKGROUND OF THE INVENTION

This invention relates to a rescue and securing harness integrally affixed to a garment, such as a sportsman's or a workmen's overalls, which harness is adapted to make possible the rescue and the lifting (or lowering) towards a safety area of a person who has become a casualty.

SURVEY OF THE PRIOR ART

The prior art has suggested a number of different kinds of harnesses, which are always separate from the article of apparel worn by the user, but these display very serious drawbacks. In the first place prior art harnesses impart a pulling stress to the groin-line and genital area. Moreover, such harnesses impart onto the backbone misaligned stresses, so that the backbone, instead of remaining in-line, is subjected to additional bending and twisting stresses, which have the only result of aggravating the already existing lesions.

SUMMARY OF THE INVENTION

The technical problem solved by the present invention is, at the outset, that of making possible the rescue of a casualty from narrow spaces in vehicles or watercrafts of any description, as well as his lift-off (or descent) towards a safety area, so as to keep the casualty in the erect posture, thereby preventing additional damages and lesions due to twist, bending or stretching of his backbone.

In the second place, the problem solved by this invention is that of providing an article of apparel which incorporates in itself the harness aforesaid, so that, as soon as an accident occurs, it is no longer necessary to fetch a harness, inasmuch as the latter is already an integral part of the garment worn by the user.

It becomes thereby possible, in the case of an accident, to afford an immediate and efficient first aid, inasmuch as it suffices to exert a pulling stress by exploiting the specially provided hook-up and suspension point in order to rescue the casualty and, thereafter, to lift him (or to descend him) towards a safety area.

Yet another outstanding feature of the invention is that, quite advantageously, the portions of the oblique sections which reach and contour the user's iliac crests are no longer immovably fastened to the points of junction of the two sections which run along the groin-lines, but cooperate with the aid of adjustable means (buckles) with the two symmetrical extensions of the two groin-line sections. The feature just now outlined makes it possible, whenever desired, to split the overalls, or any like garment, into two discrete articles of apparel, in that, then, the waist-belt shall be stably secured to the lower section of the garment (the trousers), whereas the breast-belt shall be permanently affixed to the upper section of the garment (the vest).

Therefore, if so desired, the user shall be enabled to wear either the vest alone or the trousers alone, but, at any rate, he will always have grasping members available (the rings of the breast-belt or those of the waist-belt).

Summing up, and more accurately defining, the vest shall have, affixed thereto, the vertical section running on the back along the backbone line, the two oblique sections that reach and surround the iliac crests, and the brest-belt with its attendant grasping rings.

To the trousers, instead, there shall be secured the sections which run along the thigh-gluteus lines and the waist-belt: the latter has a conventional buckleso as to clasp it adjustably.

BRIEF DESCRIPTION OF THE DRAWINGS

The invention will now be described in connection with the two embodiments, which will be exemplarily depicted in the accompanying drawings, wherein:

FIG. 4 is a front view of a person wearing the garment in question;

FIG. 5 is a view from the rear, and

FIG. 6 is a side view from the left side.

In all of the Figures, the index "s" refers to portions placed at the left side, and the index "d" is for those situated at the right side.

DESCRIPTION OF THE PREFERRED EMBODIMENTS

Figure 1:
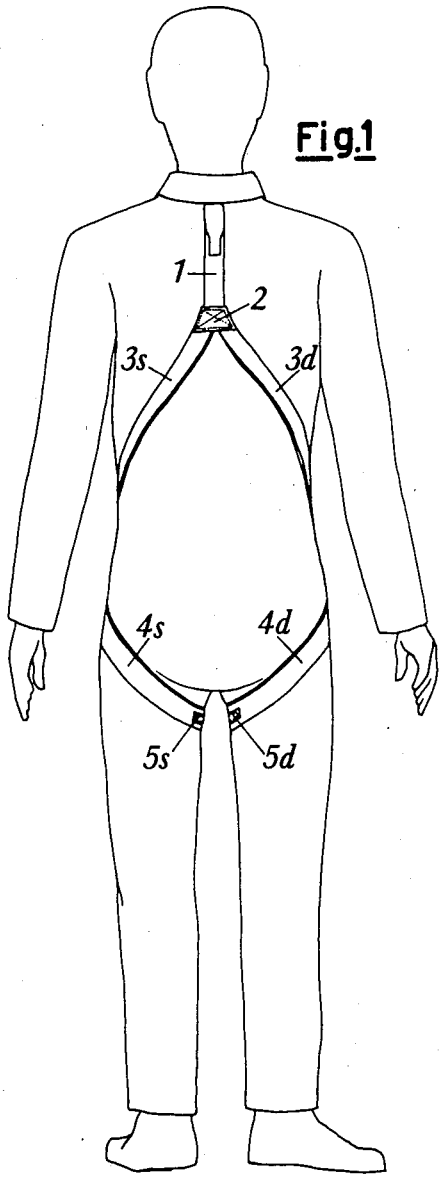
FIG. 1 is a rear view of the garment (an overalls) and shows all the component parts of the harness which can be viewed from that position.

Having now reference to FIG. 1, it will be seen that the harness integral with the garment concerned comprises a portion, 1, which starts from beneath the garment's collar and runs vertically along the user's backbone line until reaching the user's interscapular region. This is just the first section of the sustaining band which is an integral part of the garment, for example as sewn by a sturdy seamline thereto. In the interscapular region there can be a reinforcing gore 2, which can be seen in the drawing in the form of a trapezoidal piece having criss-cross seamlines, wherefrom there branch off, downwardly , one strap-section 3*s* towards the left, and the other strap-section 3*d* towards the right. The strap-sections 3*d* and 3*s* are terminated, after having run around the portions of the garment which engage the user's respective iliac crests by respective anchoring spots, 8*d* and 8*s*, situated on strap-sections 4*d* and 4*s*. Still in FIG. 1, it can be seen that the strap-sections 4*d* and 4*s* of the sustaining band run obliquely downwards along the respective junction lines between the user's thigh and the user's gluteus, to be terminated in the medial portion of the user's thigh as at 5*s* and 5*d*, respectively. The sections 4*d* and 4*s* are terminated farther frontally at the points 8*d* and 8*s*, where the aforementioned sections 3*d* and 3*s* are respectively terminated, and, more exactly, at the points 7*d* and 7*s*, whereat they provide fixed points for the adjustable belt 6.

It can now be readily appreciated that a pulling stress impressed to the section 1 is resolved, at the outset, along the sections 3*d* and 3*s*, and, farther on, along the sections 4*d* and 4*s* in a way which is both balanced and symmetrical, while still maintaining the user's backbone in line. The sustaining band is completed, as can be seen in FIGS. 2 and 3, by a belt consisting of two fixed portions, 7*d* and 7*s*, which originate from the respective points 8*d* and 8*s* of the already described strap-sections: the fixed portions 7*d* and 7*s* have, integrally united thereto, respective adjustable portions 6, which can be adjusted by a buckle or any like device adapted to lace the garment in the waist area.

Figure 2:
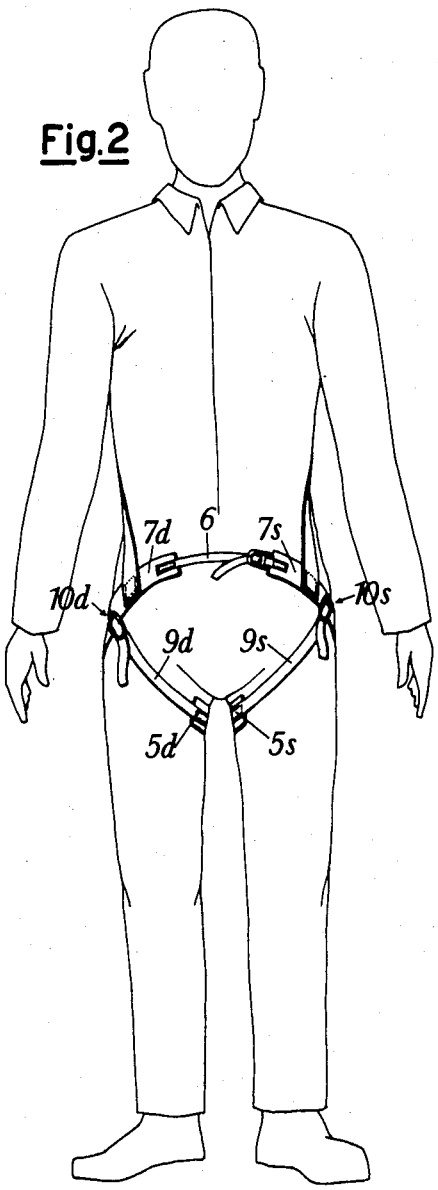
FIG. 2 shows the garment as viewed from its front, as well as the front portion of the harness affixed thereto.
Figure 3A:
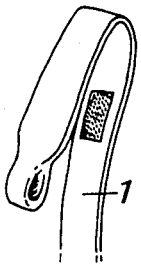
FIG. 3*a* shows an example of the way in which the portion of the harness starting from beneath the garment's collar can be terminated so as to be able to impart a lifting force which is required to rescue the casualty from a narrow space.
Figure 3B:
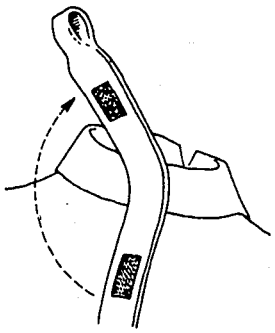
FIG. 3*b* shows another position, the opened one, of the terminal portion of FIG. 3*a*.
Figure 3:
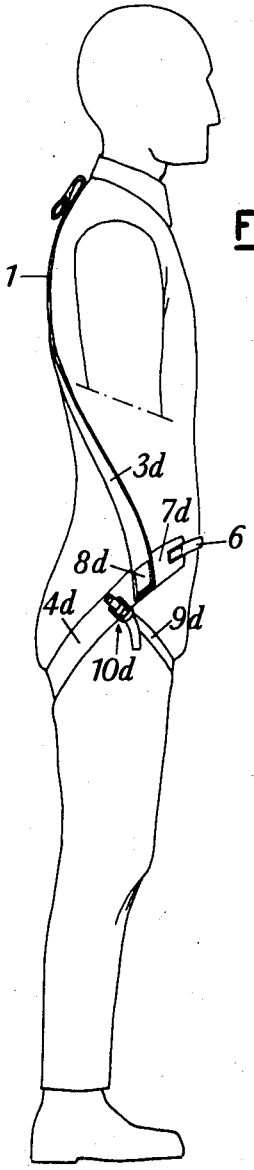

In addition, two inguinal belts, 9*d* and 9*s*, best shown in FIG. 2, start from the medial portions of the thighs, as at 5*d* and 5*s*, to be terminated at points of the strap-sections 4*d* and 4*s*, which are located on the lateral line of the user's body; also the inguinal belts can be adjusted by conventional means such as buckles and like devices, as can be seen in the right side view of FIG. 3. In FIG. 3 there can be seen the component parts which are situated on the right side, such as the anchoring point 10*d*, the terminal point 8*d*, and the section 7*d*. The corresponding component parts on the left side have the same reference numerals, but with the letter "s" instead of the letter "d".

Once that the waist-belt and the two inguinal belts have been buckled, and their adjustability is extremely convenient for the user, all the strap-sections which compose the sustaining band integral with the overalls make up a sort of a lattice structure which makes it possible to distribute the pulling stresses that are impressed to rescue the casualty from the cabin or cockpit and enables the casualty to be lifted (or descended) towards a safety area in the most rational and efficient way and, above all, without causing lesions to the backbone and without stressing it, because no one of the components of the pulling force has such a direction or magnitude as to originate deflections of the backbone, that which is of vital importance in the case of serious accidents. It is known in fact, that, whenever a casualty, who is often unconscious, is to be lifted (or descended) towards a safety area from the interior of narrow rooms of vehicles, watercrafts, aircrafts, cabins or reduced manoeuvering spaces, wells, tunnels, scaffoldings and the like, it is extremely important to avoid stresses to the backbone, which, as such, might have already been hurt in the accident or any like event.

The enlarged views of FIGS. 3*a* and 3*b* show how the hook-up or suspension point provided at the top of the sustaining band 1 is positioned farther upwards, so as to make possible to suspend the casualty in correct vertical alignment. Such a result is achieved, in the example shown, by folding down the free distal end of the section 1 partially on itself and movably securing it to the section 1 in any conventional way in the portion of 1 which is integral with the overalls or like garment.

The advantages which can be achieved with the arrangement according to the invention can now be fully appreciated when just considering that the prior art has never taught heretofore to manufacture an article of apparel incorporating, as an integral entity, a harness structure as hereinbefore described. The harness in question does not increase, in the slightest, the bulk of the garment and, moreover, its added weight is quite negligible.

Preferably, but not compulsorily, the sections of the sustaining band will consist of a strong textile material, either natural, man-made or synthetic, or of any other suitable material, provided that it is both pliable and capable of being easily sewn to the garment concerned.

Figure 4:
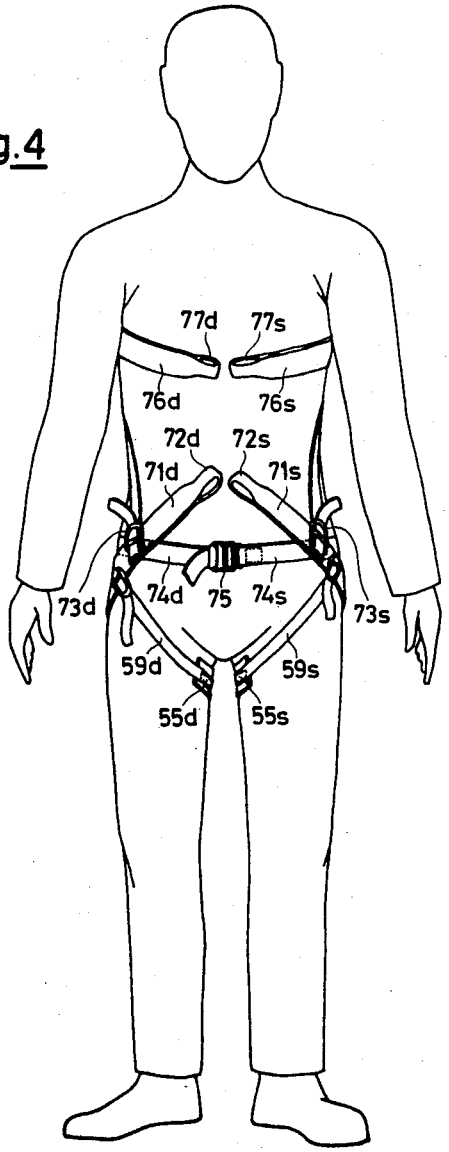
FIGS. 4,5 and 6 show the embodiment which is particularly suitable for securing persons who are in hazardous positions, namely.
Figure 5:
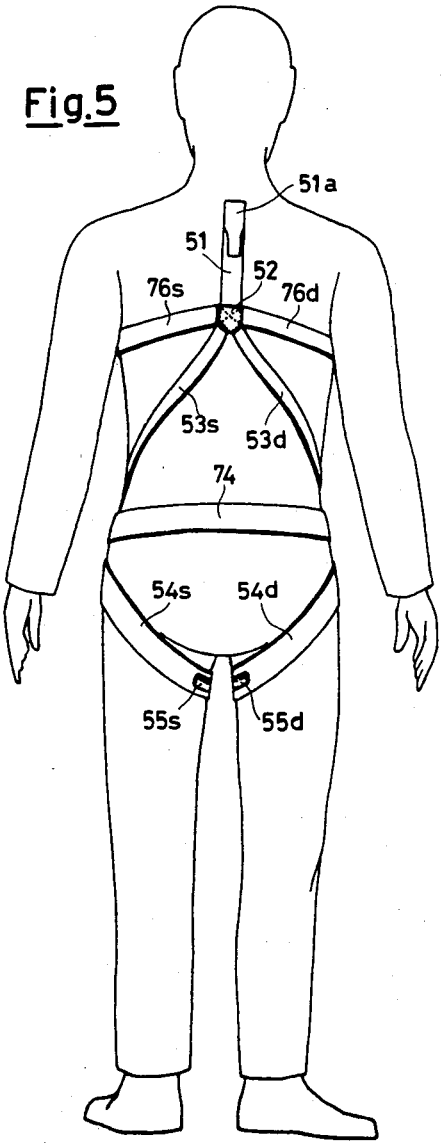
Figure 6:
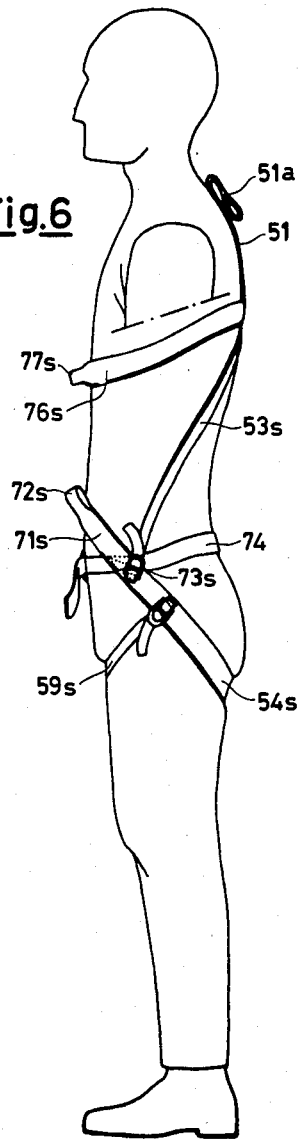

Having now particular reference to FIGS. 4, 5 and 6, there will be exemplarily described the alternative embodiment which lends itself particularly to securing persons who, for sport or work reasons, are exposed to falls from particularly hazardous positions.

It is fitting to note, in order that the alternative embodiment may be better understood, that, in FIGS. 4,5 and 6, the reference numerals from 51 to 59 correspond to component parts which have already been described in connection with FIGS. 1,2,3, 3*a* and 3*b*, whereas the reference numerals from 71 to 77 expressly connote component parts which are characteristic of the alternative embodiment. The harness in question comprises, above all, a section, 51 which starts from the overalls collar and runs vertically along the user's backbone downwards to reach the interscapular area 52 . The section 51 is sewn or otherwise permanently secured to the garment fabric: in the interscapular area 52 reinforcement piece can be provided, which can be seen in FIG. 5, in the form of a gore wherefrom there branch off downwards, one towards the left, 53*s*, and the other towards the right, 53*d*, two strap-sections, which, after having contoured the respective iliac crests, are terminated, each, by a free end which shall be buckled by a buckle (73*d*, 73*s*) as will be best shown hereinafter. The harness sections 54*s* and 54*d* run obliquely downwards along the respective thigh-gluteus junction lines to be terminated on the medial portion of the thigh where they are connected to the inguinal belts (59*s* and 59*d*) which are fastened at 55*s* and 55*d*, and are free at the opposite ends, where they cooperate with buckles affixed to the strap-sections 54*s* and 54*d*.

Furthermore, the sections 54*s* and 54*d* are extended obliquely upwards so as to provide the extension branches 71*s* and 71*d* which converge in the user's chest area and are terminated by rings 72*d* and 72*s*, respectively. These rings serve to receive a lanyard or a securing rope or a snap link (not shown), which shall be knotted or snapped on so as to join the two branches 71*d* and 71*s* together, whereas the free end of the lanyard shall be secured to a suitable anchoring point. Each extension branch 71*d* and 71*s* will have, secured thereto approximately at the level of the waist-belt 74, buckles such as 73*s* and 73*d*, respectively, intended to buckle the ends, now free, of the sections 53*d* and 53*s*. The aforementioned waist-belt, which shall be secured to the trousers section of the overalls, is indicated by the numeral 74 and has a conventional clasping and adjusting buckle 75. By so doing, if the user wants to wear only the lower portion of the garment, he has but to wear the trousers and to buckle the belt 74 with the buckle 75. Referring to FIG. 5, it can be seen that, from the interscapular junction point 52 there branch off, in addition to the strap-sections of the harness described hereinbefore, also the two strap-sections 76*s* and 76*d* of the breast-belt, which run almost horizontally and converge in the user's sternal zone.

The free ends of the strap sections 76*s* and 76*d* are terminated by respective rings 77*s* and 77*d* which can be best seen in FIG. 4. Also in this case it is possible to slip a securing lanyard, or rope or snap link through the rings 77*s* and 77*d* and to knot or hook it up, the free end of the lanyard being tied to an appropriate anchoring point. When the two portions of the garment are used together simultaneously, two couples of rings become available, wherethrough securing lanyards or ropes or snap links can be passed and this can be done in a number of different ways, also by connecting all of the four rings 72*s*, 72*d*, 77*s*, 77*d* together with the lanyard or the snap link, and then proceeding as hereinbefore explained. Of course, the ways of using the ring couples 72*s*–72*d* and 77*s*–77*d* are numerous and will be selected by the user consistently with the various operative conditions (mountain-eering, sailing, rescue, works in lofty positions involving fall hazards and so forth).

At this stage, it is extremely important to observe that the embodiment described in connection with FIGS. 4,5 and 6 is always operative in the case of an accident or a sudden collapse. As a matter of fact, if a not too serious accident occurs, there can be used, to lift the casualty, the grasping rings 72*s*, 72*d*, 77*s*, 77*d* or even only a single pair of the grasping rings can be utilized. If a serious accident occurs, in which grave lesions are present, the casualty can be lifted by the ringshaped top end piece 51*a* of the vertical section 51.

I claim:

1. A rescue- and securing harness integrally affixed to a garment having a collar, said harness comprising a sustaining band positioned in a rear portion of said garment and comprising the following component parts:

(a) a vertical strap section for running along a user's backbone, projecting beyond the garment's collar and reaching a user's interscapular region, and having means for a lift line hook-up in an uppermost position;

(b) two first strap sections, symmetrically arranged relative to a user's backbone and diverging downwards from a point of conjunction with said vertical strap section, one towards the left and the other towards the right, each first strap section reaching the region of a respective iliac crest of a user and extending frontal and obliquely downwards to reach a user's waist line;

(c) two second strap sections starting, each, from a bottom end point of each of said first strap sections and running, each, obliquely downwards along the respective junction line between a user's thigh and the gluteus, to be terminated in the medial region of a user's thigh;

(d) an adjustable setting belt having two fixed branches which are fixedly attached, each, to a respective one of said bottom end points of said strap; and (e) a pair of adjusting belts which are joined to an end point of the respective strap sections, said belts being generally oriented along a respective groinline of a user.

2. Harness according to claim 1, wherein said means for a lift line hook-up is a pull ring.

3. Harness according to claim 1, wherein the sustaining band starts directly from the point of conjunction of said two first strap sections, said point of conjunction being arranged directly under the garment's collar in correspondence with a user's first dorsal vertebrae.

4. Harness according to claim 1, wherein said first and second strap sections are directly joined together at a user's iliac region to make up a single entity.

5. Harness according to claim 1, further comprising:

two symmetrical belt sections being extensions of said two second strap sections running along inguinal lines of a user and arranged obliquely upwards so as to converge in a user's chest region, said belt sections terminating in rings to allow a securing rope to be slipped therethrough;

a belt running along a user's waist line and having adjustable buckling means; and a second belt in the form of a breast belt having two free branches which branch off from said point of conjunction and converge in a user's sternal region, said free branches terminating in rings to allow a securing rope to be slipped therethrough.

6. Harness according to claim 5, wherein the portions of said second strap sections which reach and contour the user's iliac crests cooperate with the two symmetrical belt extensions through adjustable connections with the two second strap sections which run along a user's thigh-gluteus conjunction lines.

7. Harness according to claim 6, wherein said first and second strap sections are directly joined together at a user's iliac region to make up a single entity.

8. Harness according to claim 5, wherein said first and second strap sections are directly joined together at a user's iliac region to make up a single entity.

* * * * *